US005880559A

United States Patent [19]

Fox et al.

[11] Patent Number: 5,880,559

[45] Date of Patent: Mar. 9, 1999

[54] ELECTRODES AND LAMPS

[75] Inventors: Neil Anthony Fox, Winchcombe; Peter Michael Tyler, Woodmancote, both of England

[73] Assignee: Smiths Industries Public Limited Company, London, England

[21] Appl. No.: 857,242

[22] Filed: May 16, 1997

[30] Foreign Application Priority Data

Jun. 1, 1996 [GB] United Kingdom ..... 9611487
Jul. 11, 1996 [GB] United Kingdom ..... 9614558

[51] Int. Cl.[6] ..... H01J 17/04

[52] U.S. Cl. ..... 313/633; 313/632; 313/631; 313/491

[58] Field of Search ..... 313/631, 632, 313/633, 491, 311, 345, 355, 352

[56] References Cited

U.S. PATENT DOCUMENTS 5,180,951 1/1993 Dworsky et al. .
5,526,935 6/1996 Dobashi et al. ..... 313/491
5,536,193 7/1996 Kumar .
5,572,088 11/1996 Aizawa et al. ..... 313/491
5,585,694 12/1996 Goldburt et al. ..... 313/491

FOREIGN PATENT DOCUMENTS 2 244 855 12/1991 United Kingdom .
2260641 4/1993 United Kingdom .
WO 94/28571 12/1994 WIPO .

*Primary Examiner*—Nimeshkumar D. Patel
*Attorney, Agent, or Firm*—Pollock, Vande Sande & Amernick

[57] ABSTRACT

A cold cathode electrode for a discharge lamp has a metal substrate supporting a layer of diamond, so as to increase the electron yield of the electrode. The substrate may be a helical nickel wire with a layer of diamond forming it into a continuous tube.

14 Claims, 1 Drawing Sheet

ELECTRODES AND LAMPS

BACKGROUND OF THE INVENTION

This invention relates to electrodes and to discharge lamps including electrodes.

Discharge lamps have two electrodes spaced from one another within a sealed envelope containing a discharge gas, or mixture of gases, at reduced pressure. When a sufficient voltage is applied between the two electrodes, discharge is produced within the gas, causing radiation. Usually, the radiation is predominantly in the UV or VUV range and, where visible light is needed, the envelope is coated with a phosphor material which fluoresces under UV irradiation to produce visible light.

The electrodes can be heated so that electrons are emitted from the cathode by primary emission. By contrast, with cold-cathode electrodes, ion bombardment of the cathode causes the secondary emission of electrons. Although hot-cathode lamps have a greater electrical efficiency, cold-cathode lamps have the advantage of a longer electrode life. An example of a cold-cathode lamp is described in, for example, GB2244855. Because of the relatively low electrical efficiency of cold-cathode lamps, anything that can be done to increase the production of electrons from the cathode is particularly important to the performance of the lamp.

BRIEF SUMMARY OF THE INVENTION

It is an object of the present invention to provide an improved cold-cathode electrode and a lamp including an improved electrode.

According to one aspect of the present invention there is provided a cold-cathode electrode for a discharge lamp, the electrode having an exposed surface substantially of a diamond material such as to increase secondary electron yield.

The electrode preferably comprises a metal substrate, such as of molybdenum, titanium or nickel, supporting a layer providing the surface. The surface may be smooth or roughened. The electrode may be hollow and the surface may be on the inside of a tube substantially of a diamond material. The electrode may comprise a helical metal substrate and a layer substantially of a diamond material on the helical substrate.

According to another aspect of the present invention there is provided a cold cathode electrode for a discharge lamp, the electrode having a nickel substrate and a layer of diamond on the substrate, the layer being sufficiently thin to be transparent to photons thereby allowing the photons to strike the nickel substrate and promote the injection of electrons from the nickel into the diamond.

According to a further aspect of the present invention there is provided a method of forming a cold cathode electrode for a discharge lamp comprising the steps of providing a helical metal substrate and depositing on the substrate a layer substantially of a diamond material until the diamond material bridges adjacent turns of the helical substrate.

According to a fourth aspect of the present invention there is provided an electrode made by a method according to the above further aspect of the invention.

According to a fifth aspect of the present invention there is provided a discharge lamp including an electrode according to the above one, other or fourth aspect of the invention.

The lamp preferably includes two of said electrodes and may include a phosphor layer arranged to fluoresce when irradiated by radiation produced within the lamp.

A cold-cathode discharge lamp including two electrodes, according to the present invention will now be described, by way of example, with reference to the accompanying drawings.

DETAILED DESCRIPTION OF THE PREFERRED EMBODIMENTS

Figure 1:
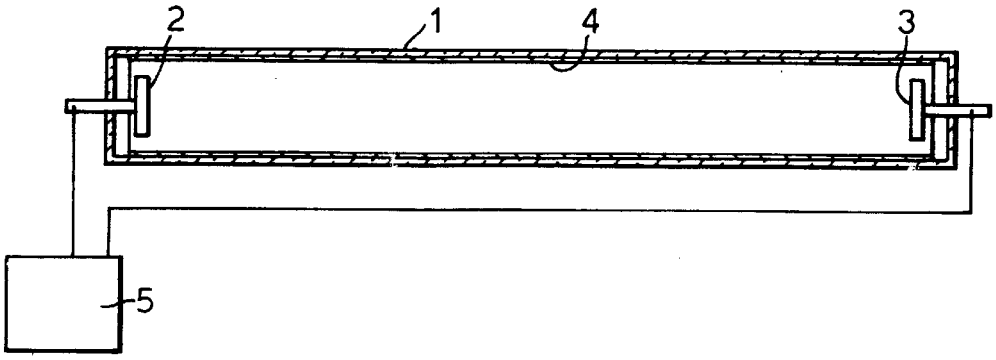
FIG. 1 is a partly sectional side elevation of the lamp.

With reference to FIG. 1, there is shown a cold-cathode discharge lamp having a tubular glass envelope 1 of circular section containing two electrodes 2 and 3 located at opposite ends of the envelope, separated by a discharge space. The envelope 1 is sealed at its ends to enclose a volume of a discharge gas or gas mixture at a pressure greater than 1 torr and preferably between about 1 torr and 20 torr. This pressure is considerably higher than the pressure in field-emission devices, of around $10^{-7}$ torr, where it is necessary to reduce to a minimum the amount of charged ions bombarding the cathode. On its inside, the envelope 1 is coated with a layer 4 of phosphor material. The electrodes 2 and 3 are connected to a power supply 5, which supplies an ac voltage between the electrodes so that each electrode alternately operates as a cathode.

Figure 2:
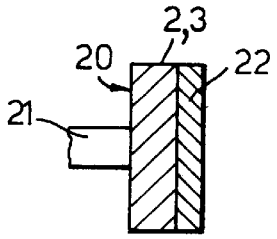
FIG. 2 is a sectional side elevation view of a cold cathode electrode of the lamp.

With reference to FIG. 2, the electrodes 2, 3 comprise a plate or substrate 20 of a metal, such as molybdenum or titanium. The plate 20 is mounted at its rear surface on a support 21 extending out of the end of the envelope and providing an electrical path to the electrodes. The electrodes 2 and 3 are mounted axially within envelope 1 with the front surface of each electrode facing one another. The front surface of the plate 20 of each electrode is coated with a thin, smooth layer 22 of a high purity diamond material by a CVD process.

The diamond material of the layer 22 has a very high secondary electron yield compared with conventional cold-cathode emissive coatings. This means that the cathode fall voltage in the lamp is reduced, thereby enabling the overall power requirements of the lamp to be reduced. Diamond is also very stable chemically. This reduces the amount of material sputtered from the cathodes by ion bombardment and thereby reduces the contamination of the discharge. It also reduces the amount of sputtered material deposited on the phosphor 4 so that the transmission properties of the phosphor are not degraded as quickly as in conventional lamps and lamp life is thereby increased. Diamond also has a very high thermal conductivity so that heat produced by the ion bombardment is rapidly conducted away to the substrate 20 even at relatively high currents, without overheating.

Figure 3:
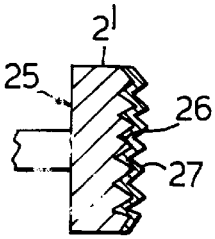
FIGS. 3 to 6 are side elevation views of alternative cold cathode electrodes of the lamp.

The electrodes can take various different forms, as shown, for example, in FIG. 3. In this example, the electrode 2' has a plate or substrate 25, similar to the plate 20 shown in FIG. 2, except that the front surface 26 is roughened by a series of grooves or similar profiles. The diamond layer 27 is formed on top of this roughened surface 26 so that it follows the surface and is itself rough on its front surface. This roughened, profiled surface, in effect, forms a series of small recesses over the surface of the electrode, which is known to increase electron production.

Figure 4:
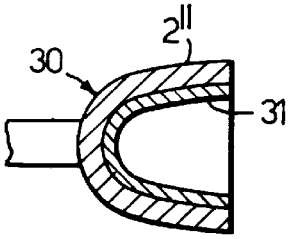

FIG. 4 shows a further electrode 2" in the form of a hollow shell or can 30 of a metal, such as molybdenum or titanium. The can 30 is closed at its rear end, where it is supported, and is open at its forward end, the forward ends of the two electrodes facing one another. The inside of the electrode is coated with a layer 31 of a diamond material.

Figure 5:
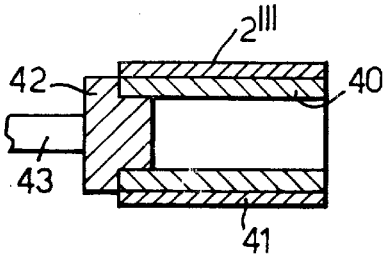

FIG. 5 also shows a hollow electrode 2'" with a tube 40 of a diamond material. The tube 40 may be formed by growing a diamond film on a ceramic or metal core, which is then etched away to leave the diamond as a tube. The outer surface of the tube 40 is coated with a layer 41 of a high work function metal and the rear end of the tube is closed by a metal plug 42 attached to a support 43, by which the electrode is supported.

Figure 6:
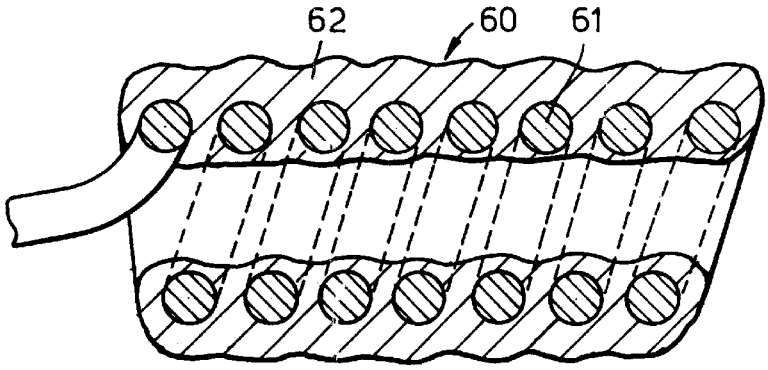

FIG. 6 shows a tubular electrode 60 formed from a helical nickel wire 61 having a diamond coating 62. Nickel is used for the wire 61 because its crystallographic structure is closely matched to that of diamond, enabling a low-stress diamond film to be grown. Nickel is also compatible with discharge lamp manufacture. The electrode 60 is made by closely winding the wire into a helix on a jig and then growing the diamond layer on the helix. During the growth phase of diamond deposition, the thickness of the diamond builds up and the space between the adjacent turns of the diamond-coated wire becomes smaller. A stage is reached during the deposition period when the space is bridged by diamond, because of fusing of adjacent film structures. When the diamond film on adjacent turns fuses together, this prevents further growth of the diamond film on the interior surface of the electrode. At the end of the deposition process, the completed electrode, therefore, has a thinner layer of diamond on its inner surface than on its exterior surface. Forming a diamond-coated tube in this way from a helical wire produces a continuous coating of CVD thin film diamond.

A thin diamond layer, which is transparent to UV and visible radiation, has the advantage that the nickel wire can inject electrons into the diamond in response to photons generated by the hollow cathode effect in the interior of the electrode. This further enhances the effective secondary electron emission from the diamond surface.

It will be appreciated that various other shapes of electrode are possible. The lamp need not be a straight tube but could, for example, be a curved tube or of planar form.

What we claim is:

1. A cold-cathode electrode for a discharge lamp, said electrode being hollow and comprising an electrically-conductive substrate and an internal exposed surface substantially of a diamond material such as to increase secondary electron yield from within the electrode.

2. An electrode according to claim 1, wherein said substrate is of a metal.

3. An electrode according to claim 2, wherein said substrate is from a group comprising: molybdenum, titanium or nickel.

4. An electrode according to claim 1, wherein said surface is substantially smooth.

5. An electrode according to claim 1, wherein said surface is roughened.

6. An electrode according to claim 1, wherein said hollow electrode includes a tube substantially of a diamond material, and wherein said surface is on an inside of said tube.

7. An electrode according to claim 1, wherein said substrate is a helical metal substrate and said diamond surface is provided by a layer of diamond on said helical substrate.

8. An electrode according to claim 7, wherein said layer of diamond is thinner on an inner surface of said helical substrate than on an outer surface.

9. A method of forming a cold cathode electrode for a discharge lamp comprising the steps of providing a helical metal substrate and depositing on said substrate a layer substantially of a diamond material until the diamond material bridges adjacent turns of the helical substrate and forms an inner surface of diamond.

10. A cold cathode electrode for a discharge lamp, comprising a hollow nickel substrate and a layer of diamond on an inner surface of said substrate, wherein said layer is sufficiently thin to be transparent to photons thereby allowing the photons to strike said nickel substrate and promote the injection of electrons from said nickel into said diamond.

11. A cold cathode electrode for a discharge lamp, comprising a helical metal substrate and a layer of diamond on said substrate, said layer of diamond bridging adjacent turns of said helical substrate to form a continuous tube with an inner surface of diamond.

12. A discharge lamp comprising an outer envelope and two electrodes located in said envelope and separated from one another by a discharge space, wherein at least one of said electrodes is hollow and comprises a metal substrate and a layer of diamond on an internal surface of the substrate such as to increase the electron yield of said electrode.

13. A discharge lamp according to claim 12 including a phosphor layer on the inside of said envelope arranged to fluoresce when irradiated by radiation produced by discharge within the lamp.

14. A discharge lamp according to claim 12, wherein both of said electrodes are hollow and both comprise a metal substrate and a layer of diamond on an internal surface of the substrate.

* * * * *